United States Patent [19]

Shuey et al.

[11] Patent Number: 4,477,022

[45] Date of Patent: Oct. 16, 1984

[54] POLARIZING AND LATCH ARRANGEMENT FOR AN ELECTRICAL CONNECTOR

[75] Inventors: John R. Shuey, Carlisle; Donald R. Widener, Mechanicsburg, both of Pa.

[73] Assignee: AMP Incorporated, Harrisburg, Pa.

[21] Appl. No.: 351,560

[22] Filed: Feb. 23, 1982

[51] Int. Cl.[3] ..... H01R 11/00; H01R 13/62

[52] U.S. Cl. ..... 339/59 M; 339/89 M; 339/136 M; 339/186 M

[58] Field of Search ..... 339/89, 90, 186 M, 59 R, 339/59 M, 126 RS, 128, 136 R, 136 M

[56] References Cited

U.S. PATENT DOCUMENTS

| | | | |
|---|---|---|---|
| 3,008,116 | 11/1961 | Blanchenot | 339/90 |
| 3,116,960 | 1/1964 | Olsson et al. | 339/128 |
| 3,202,956 | 8/1965 | Hennessey, Jr. | 339/90 |
| 3,614,711 | 10/1969 | Anderson et al. | 339/90 R |
| 4,193,655 | 3/1980 | Herrmann, Jr. | 339/31 R |
| 4,268,103 | 5/1981 | Schildkraut et al. | 339/89 M |
| 4,322,121 | 3/1982 | Riches et al. | 339/89 M |

FOREIGN PATENT DOCUMENTS

| | | | |
|---|---|---|---|
| 2807366 | 8/1978 | Fed. Rep. of Germany | 339/128 |

*Primary Examiner*—John McQuade
*Assistant Examiner*—Gary F. Paumen
*Attorney, Agent, or Firm*—Adrian J. LaRue; Anton P. Ness

[57] ABSTRACT

An electrical connector comprises matable housing members and contact-carrying inserts. Matable electrical contact members are secured in passageways in each of the inserts and a coupling member holds the housing members, contact-carrying inserts, and electrical contact members in matable engagement. The housing members and the contact-carrying inserts include projections and flexible latching members to latchably secure the contact-carrying inserts in polarized positions in the housing members for proper matable engagement with each other. According to another aspect of the present invention, the flexible latching members including the polarizing areas of the contact-carrying inserts can be oriented relative to their respective housing members by angular selection to assure mating engagement between only these housing members and inserts so that proper electrical interconnection is made between electrical circuits.

4 Claims, 7 Drawing Figures

POLARIZING AND LATCH ARRANGEMENT FOR AN ELECTRICAL CONNECTOR

FIELD OF THE INVENTION

This invention relates to electrical connectors and more particularly to a polarizing and latch arrangement for latching contact-carrying inserts into connector housing members and defining a polarizing arrangement between the matable inserts.

BACKGROUND OF THE INVENTION

Contact-carrying inserts of some electrical connectors are typically secured in their housing members by use of snap rings or pins. The insert that is secured in a housing member via a snap ring is oriented in the housing member by an orienting arrangement between the insert and the housing member against a stop surface and the snap ring is snapped into an inside annular groove in the housing member securing the insert therein. Pins are then used to secure the other contact-carrying insert in the other housing member, but the other insert has to be secured in the other housing member in such an angular orientation relative to the other housing member so as to correspond to the angular orientation of the first-mentioned insert relative to its housing member so that the polarizing arrangement therebetween is properly aligned for matable engagement thereof.

Such an arrangement has proven to be satisfactory, but use of snap rings and pins requires extra parts, requires machining a groove in the housing member in which the snap ring is to be disposed, constitutes a problem in inserting the snap ring in its groove, and requires properly orienting the other insert in the other housing member prior to securing the pins therein so that coincidence of orientation between the matable inserts and housing members takes place to assure matable engagement therebetween.

SUMMARY OF THE INVENTION

According to the present invention, an electrical connector comprises matable housing members and contact-carrying inserts. Matable electrical contact members are secured in passageways in each of the inserts and a coupling member holds the housing members, contact-carrying inserts, and electrical contact members in matable engagement. The housing members and the contact-carrying inserts include projections and flexible latching members to latchably secure the contact-carrying inserts in polarized positions in the housing members for proper matable engagement with each other.

According to another aspect of the present invention, the flexible latching members including the polarizing areas of the contact-carrying inserts can be oriented relative to their respective housing members by angular selection to assure mating engagement between only these housing members and inserts so that proper electrical interconnection is made between electrical circuits.

DETAILED DESCRIPTION OF PREFERRED EMBODIMENTS

Figure 1:
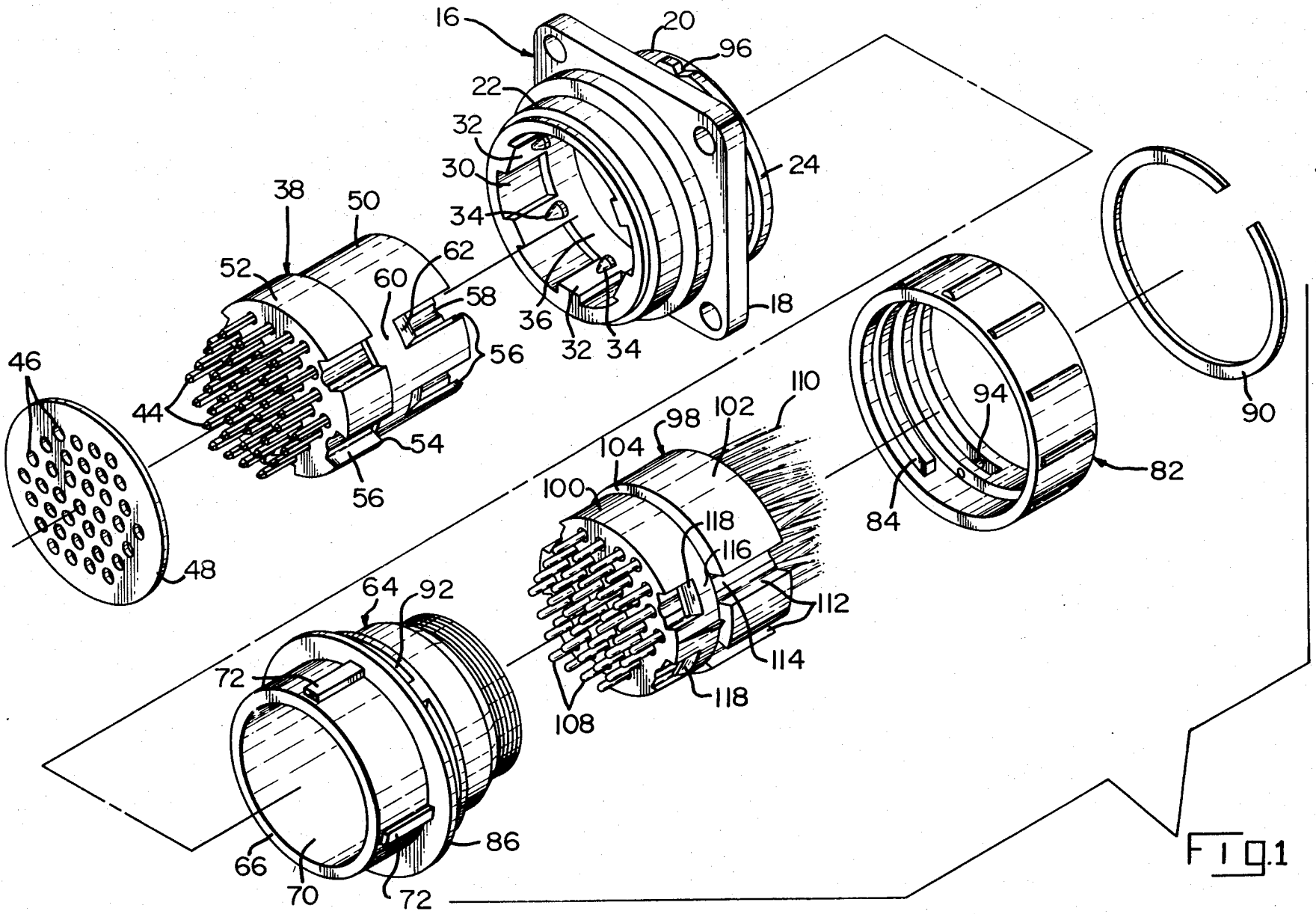
FIG. 1 is an exploded perspective view of the members of the electrical connector of the present invention.

FIGS. 1–6 illustrate electrical connector 10 which includes electrical plug 12 and electrical receptacle 14. As can be discerned, electrical connector 10 is preferably of circular configuration. Electrical plug 12 includes a housing member 16 which includes a mounting flange 18, an outer section 20, and an inner section 22. Outer section 20 has threads 24 on its outer surface and a bore 26 on its inner surface. Keyways 28 are disposed in bore 26.

Inner section 22 of housing member 16 has a bore 30 out of which extend projections 32 at spaced locations along bore 30 which define key members. A latching projection 34 is located on the inner ends of projections 32. An internal flange 36 is located in housing member 16 between bores 26 and 30.

Contact-carrying insert 38 is molded from a suitable dielectric plastic material and it includes passageways 40 extending therethrough which have electrical receptacles 42 of conventional design secured therein. Electrical receptacles 42 include electrical posts 44 which extend through holes 46 in a sealing member 48 which is secured onto insert 38. Electrical posts 44 are to be soldered to appropriate circuits on a printed circuit board (not shown) for electrical connection therewith. Electrical receptacles 42 can be terminated to electrical conductors in accordance with conventional terminating practices if desired.

Insert 38 has outer section 50 and inner section 52 with a stop surface 54 therebetween. Grooves 56 extend along the length of insert 38 and they are positioned therearound in coincidence with key projections 32 of housing member 16. The bottoms of grooves 56 have concave section 58 therealong. Flexible latching members 60 are located in outer section 50 along a section of each groove 56. They have beveled surfaces 62 at their leading ends.

Figure 2:
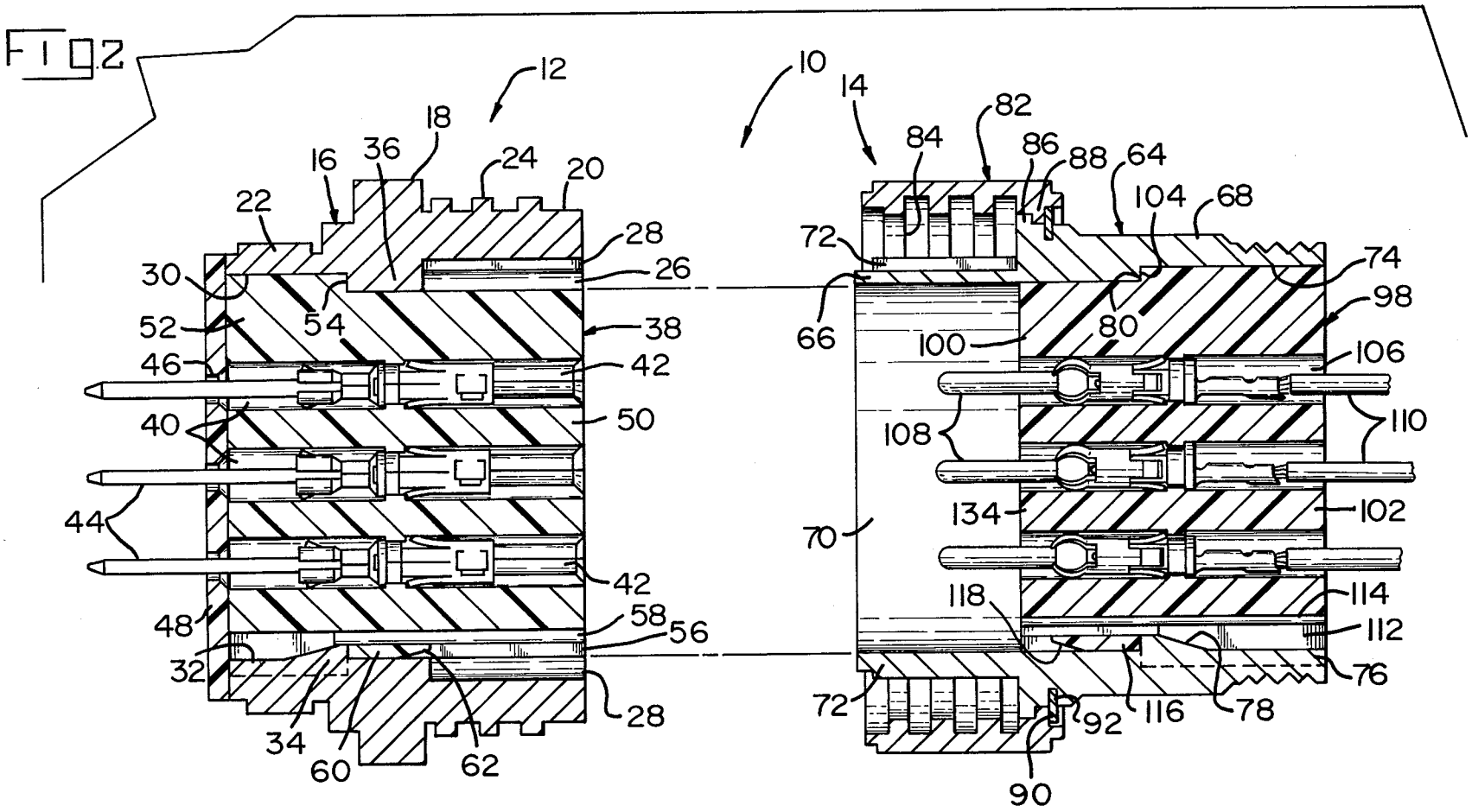
FIG. 2 is a cross-sectional view of the matable parts of the electrical connector of FIG. 1 in position for matable engagement.
Figure 3:
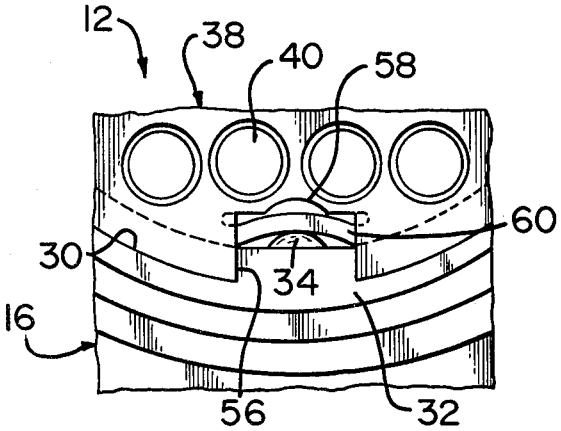
FIG. 3 is a part rear elevational view showing a contact-carrying insert as it is being latchably positioned in its housing member.
Figure 4:
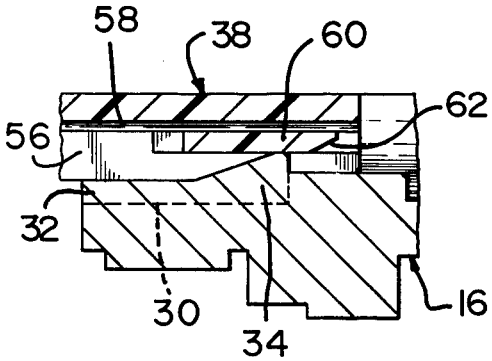
FIG. 4 is a cross-sectional view of FIG. 3.
Figure 5:
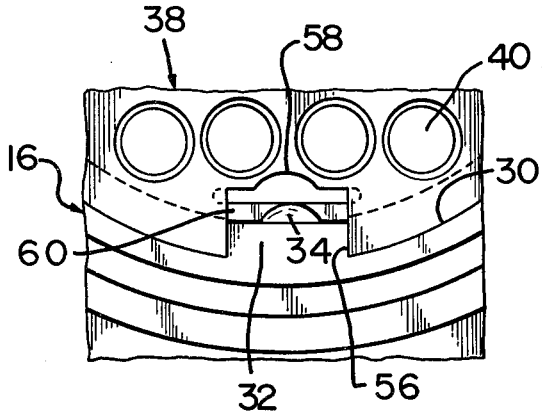
FIG. 5 is a view similar to FIG. 3 showing the contact-carrying insert latchably secured in its housing member.
Figure 6:
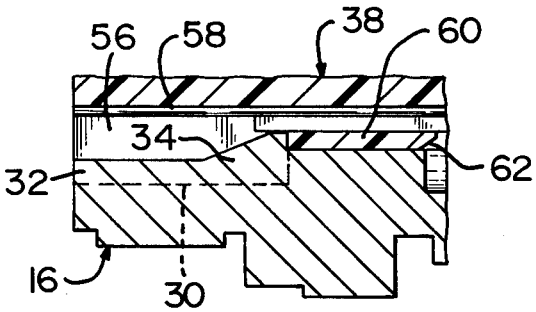
FIG. 6 is a cross-sectional view of FIG. 5.

In assembly, electrical receptacles 42 are secured in passageways 40 and contact-carrying insert 38 has grooves 56 positioned in alignment with key projections 32 whereupon insert 38 is moved axially along housing member 16. As insert 38 is moved within housing member 16, the beveled surfaces of latching projections 34 engage beveled surfaces 62 of flexible latching members 60 to facilitate the movement of latching members 60 thereover and concave sections 58 enable flexible latching members 60 to flex thereinto in order to enable latching members 60 to move completely along latching projections 34 until insert 38 is completely housed in housing member 16 as illustrated in FIG. 2 with outer section 50 of insert 38 disposed in outer section 20 of housing member 16, and inner section 52 of insert 38 is disposed in inner section 22 of housing member 16 with stop surface 54 in engagement with internal flange 36. In this position, latching members 60 have moved outwardly into engagement with the bore of flange 36 due to the flexible nature of latching members 60 and into latching position with latching projections 34 as illustrated in FIGS. 2 and 6.

Electrical receptacle 14 includes metal housing member 64 having an outer section 66 and an inner section 68. Outer section 66 has a bore 70 and key projections 72 on its outer surface at spaced locations therearound for matable engagement with keyways 28 in plug housing member 16 to assure proper mating engagement therebetween.

Inner section 68 of housing member 64 includes a bore 74 which contains spaced projections 76 therearound in the same manner as spaced projections 32 in bore 30 of housing member 16. Latching projections 78 are located on the inner ends of projections 76 in the same manner as latching projections 34 of housing member 16. A stop surface 80 is located at the junction of bores 70 and 74.

A metal coupling ring 82 is freely mounted onto housing member 64 for free rotation relative thereto and it includes threads 84 for matable engagement with threads 24 to couple housing members 16 and 64 together and securing same in a matably engaged condition. Housing member 64 includes a flange 86 against which a flange 88 on coupling ring 82 engages and a snap ring 90 is disposed in groove 92 of housing member 64 to retain coupling ring 82 in position on housing member 64. A plastic rod 94 is secured across threads 84 adjacent the inner ends thereof for engagement with a groove 96 adjacent the outer end of threads 84 to provide a tactile and audible means to indicate the fully-mated condition of plug 12 and receptacle 14 along with the electrical connection between the electrical receptacle and electrical pins therein. This arrangement is completely disclosed in U.S. patent application Ser. No. 345,962 filed Feb. 5, 1982, the disclosure of which is completely incorporated herein by reference. This rod and groove audible and tactile arrangement also maintains the plug and receptacle in matable engagement in the presence of vibration.

Contact-carrying insert 98 is similar in construction to that of contact-carrying insert 38 in that it has an outer section 100 which fits within bore 70 of outer section 66 of housing member 64 and an inner section 102 which fits within bore 74 of inner section 68. A stop surface 104 at the junction of outer section 100 and inner section 102 engages stop surface 80 in housing member 64 to limit inner movement of insert 98 within housing member 64. Passageways 106 extend through insert 98 in which are secured electrical pins 108 which electrically mate with respective electrical receptacles 42. Electrical pins 108 are terminated to electrical conductors 110 in accordance with conventional terminating practices.

Grooves 112 extend through insert 98 and have concave sections 114 in the bottom surfaces thereof in the same manner as grooves 56 of insert 38, and grooves 112 are located in coincidence with keying projections 76 in bore 74 to enable insert 98 to be positioned in housing member 64. Each of grooves 112 includes a flexible latching member 116 having a beveled surface 118 and flexible latching members 116 function in the same manner as flexible latching members 60 enabling them to move along the beveled surfaces of latching projections 78 into latching engagement therewith as illustrated in FIG. 2 in the same manner as latching members 60. Latching members 60 and 116 are integral with respective inserts 38 and 98, thereby precluding the need for snap rings, rods, or other similar securing devices to secure the contact-carrying inserts in position in their respective housing members. The arrangement of grooves 56 on insert 38 relative to keying projections 32 and the same arrangement of grooves 112 in insert 98 relative to keying projections 76 of housing member 64 assures the proper orientation of inserts 38 and 98 in respective housing members 16 and 64 so that electrical receptacles 42 properly interconnect with electrical pins 108 so that the proper electrical circuits are interconnected when housing members 16 and 64 are interconnected through keyways 28 and key projections 72.

Figure 7:
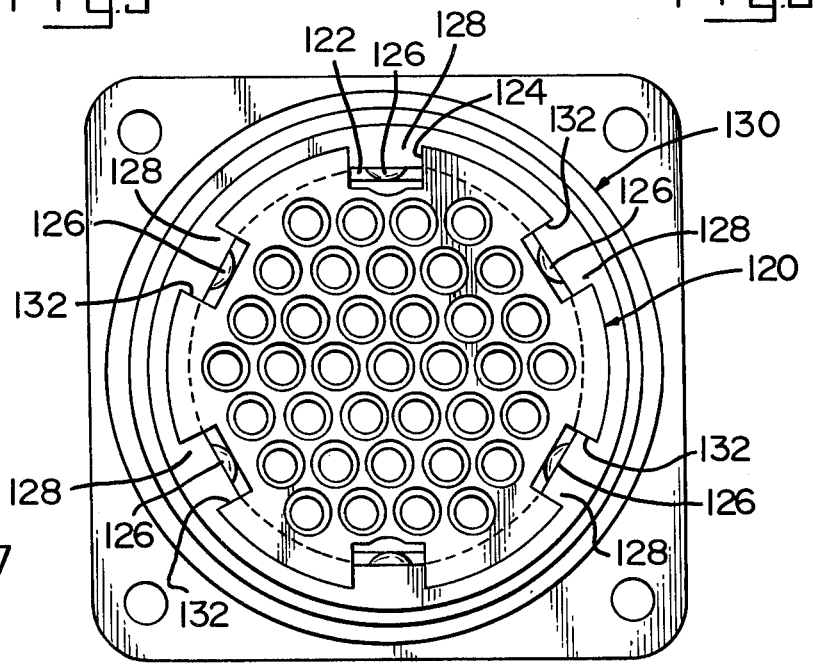
FIG. 7 is a rear elevational view of an alternative embodiment of the present invention.

Whereas the inserts 38 and 98 have flexible latching members 60 and 116 in relation to each groove 56 and 112, the embodiment of FIG. 7 differs therefrom in that each contact-carrying insert 120 for the electrical receptacles and electrical pins contains flexible latching members 122 in opposed grooves 124 which are in engagement with latching projections 126 located on the inner ends of keying projections 128 of housing member 130 which latchably secures insert 120 within housing member 130. The remaining grooves 132 of insert 120 do not contain any flexible latching members but they do cooperate with keying projections 128 when insert 120 is positioned in housing member 130. The arrangement of FIG. 7 enables contact-carrying inserts 120 of each of the housing members to be oriented in six different angular orientations relative to housing member 130 when the connector housing members are mated together to make certain that the electrical receptacles and electrical pins are properly interconnected.

If desired, insert 98 can be provided with a hood section extending outwardly from front surface 134 and spaced inwardly from outer section 66 of housing 64 to mate with outer section 50 of insert 38, and the hood section of insert 98 along with outer section 50 of insert 38 would be provided with a keying arrangement to make certain that proper mating engagement therebetween takes place in the same way as the plug and receptacle of the invention as disclosed in U.S. patent application Ser. No. 235,455, filed Feb. 18, 1981 of which the disclosure is incorporated by reference herein. In this arrangement, both the housing members and the inserts would be provided with keying arrangements to polarize the mating engagement therebetween.

We claim:

1. An insert-in-housing assembly for an electrical connector comprising a housing member, and a contact-carrying insert member latchably securable therein containing one or more electrical contact members, characterized in that:

said contact-carrying insert member has an outer section having integral flexible latching means therearound, and said insert member has grooves underlying said integral flexible latching means, said housing member has an inner section having keying projections on each of which is located a latching projection;

said keying projections correspond with said grooves and are matably engageable therewith to position said insert member in said housing member;

said integral flexible latching means is capable of being flexed by said latching projections into said grooves as said latching projections move thereover during assembly of said insert member into said housing member and thereafter returning to an unflexed condition latchably engaging said latching projections when said insert member is in a fully mated condition in said housing;

2. An electrical connector assembly as set forth in claim 1 wherein said insert member includes a pair of opposing ones of said grooves and said integral flexible latching means with said grooves being matably engageable with said keying projections thereby selectively positioning said insert member in said respective housing member relative thereto for proper matable engagement of said electrical members.

3. An assembly for an electrical connector as set forth in claim 1 characterized in that said integral flexible latching means and said latching projections have cooperating beveled surfaces enabling them to move easily over each other during positioning of said contact-carrying insert member into said housing member.

4. An assembly for an electrical connector as set forth in claim 1 characterized in that bottoms of said grooves have concave sections enabling said integral flexible latching means to flex thereinto as said integral flexible latching means moves along said latching projections.

* * * * *